United States Patent [19]

Jakob

[11] 4,257,475

[45] Mar. 24, 1981

[54] RECOVERY OF THE HEAT CONTENT OF CORROSIVE AND DUST-CONTAINING GASES

[75] Inventor: Fritz Jakob, Achmüle, Fed. Rep. of Germany

[73] Assignee: Linde Aktiengesellschaft, Wiesbaden, Fed. Rep. of Germany

[21] Appl. No.: 17,640

[22] Filed: Mar. 5, 1979

[30] Foreign Application Priority Data

Mar. 4, 1978 [DE] Fed. Rep. of Germany ..... 2809358

[51] Int. Cl.[3] ..... F28D 17/00; F28G 5/00

[52] U.S. Cl. ..... 165/1; 165/5; 55/73; 55/96; 55/82; 55/269; 55/261

[58] Field of Search ..... 165/5, 1; 55/73, 96, 55/80, 82, 301, 261, 267

[56] References Cited

U.S. PATENT DOCUMENTS

| | | | |
|---|---|---|---|
| 675,245 | 5/1901 | Richards et al. | 165/5 X |
| 710,748 | 10/1902 | Cabot | 165/5 X |
| 3,023,836 | 3/1962 | Kasbohm et al. | 165/5 X |

*Primary Examiner*—Albert W. Davis

*Attorney, Agent, or Firm*—Millen & White

[57] ABSTRACT

The heat content of corrosion and dust particle-laden gases is recovered in a process employing at least two regenerators cyclically interchangeable. In the heat-release cycle, hot waste gases are passed through the regenerator in one direction, thereby releasing their heat content to the packing, e.g., quartzite rocks or porcelain Raschig rings. In the heat recovery cycle, a clean gas, e.g., superatmospheric air, is passed through the hot regenerator in the opposite direction, thereby recovering the heat content of the packing. Immediately prior to switching the regenerator from the heat release cycle to the heat recovery cycle, at least a portion of the high pressure recovery gas (e.g., air) from the regenerator operated in the heat recovery cycle is introduced into the warm end of the regenerator in the heat release cycle, thereby creating a high pressure switching surge. The switching surge is a purging step inasmuch as if effectively dislodges dust particles entrained in the packing and carries them to a downstream filter. The heat content of the resultant hot clean gas is recovered in a waste gas boiler of preferably a turbine, especially turbine coupled to a compressor for entering air.

21 Claims, 1 Drawing Figure

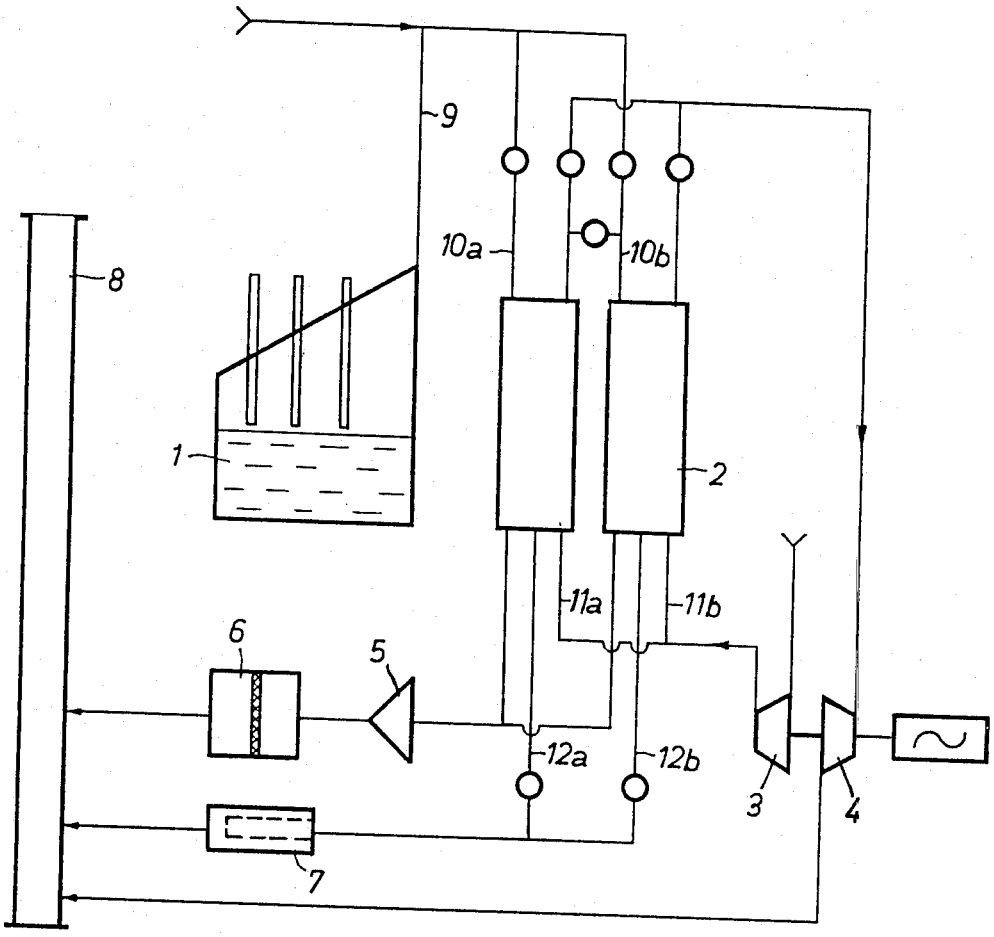
9
10a
10b
8
1
2
11a
11b
6
5
12a
12b
3
4
7

RECOVERY OF THE HEAT CONTENT OF CORROSIVE AND DUST-CONTAINING GASES

BACKGROUND OF THE INVENTION

This invention relates to the recovery of the heat content of waste gases. More particularly, this invention relates to a process for the recovery of the heat content of waste gases having significant and highly troublesome proportions of dust and corrosive substances.

Heretofore, the heat content of waste gases from various industrial processes has been lost to a large extent because of the high dust and corrosive particles content thereof. Such lost heat content represents large quantities of wasted energy because these gases are frequently discharged into the atmosphere at relatively high temperatures.

Conventional heat exchangers if used for such waste gases, are plagued by fouling and a low rate of heat recovery. Waste heat boilers, which also have been used to recover heat content of the waste gase, have operational limitations which greatly inhibit or even prohibit the economical use thereof in the conventional plants. Such limitations include, e.g., high waste gas sulfur content and thus formation of sulfuric acid at temperatures below about 250° to 300° C., and a very high dust content.

Accordingly, previously known systems for the recovery of heat content of the waste gases were subject to operational drawbacks which prevented effective utilization of the thermal energy and which necessitated frequent interruptions in their continuous operation.

Accordingly, it is a principal object of this invention to improve the extent of recovery of the heat content of waste gases containing corrosive components and/or dust particles.

A further object of this invention is to reduce the susceptibility of heat-recovery systems to frequent interruptions in their operation.

It is yet another object of this invention to provide a method for removing dust particles and sulfuric acid from the packing of the regenerator, thereby preventing contamination of the purge gas with these contaminants.

Upon further study of the specification and the appended claims, further objects and advantages of this invention will become apparent to those skilled in the art.

SUMMARY OF THE INVENTION

Briefly, in accordance with this invention, hot waste gases, contaminated with dust and corrosive substances, are passed through a first packed regenerator (heat release cycle). The heat content of the waste gases is thus transferred to the packing, and dust and corrosion substances are deposited thereon. After the heat release cycle is completed, pressurized heat recovery gas (e.g., air) is passed countercurrently through the regenerator, thereby recovering the heat content from the packing.

While the first regenerator is in the heat release cycle, the remaining regenerators (at least one other regenerator must be employed) are operated in the heat recovery cycle.

The dust deposits are removed from the packing just before the switching operation of the regenerators from the heat release cycle to the heat recovery cycle, e.g., by passing a pressure surge of the high pressure gas from the pressurized heat recovery cycle regenerator preferably into the warm end of the heat release cycle regenerator to purge the dust particles from the packing and preferably out from the cold end of the regenerator. In this way, the heat recovery gas picks up very little, if any, of the dust during the heat recovery cycle itself. With respect to residual corrosive substances, such as sulfuric acid in particular, remaining in the packing after the purge step, the heat recovery gas is compressed to a sufficiently high pressure so that only an insignificant portion of the sulfuric acid is vaporized into the heat recovery gas.

The resultant heated heat recovery gas is then expanded in a turbine or a waste heat boiler to recover its heat content.

DETAILED DISCUSSION

In accordance with this invention, hot waste gases containing corrosive components and/or dust particles, optionally mixed with air, are first passed at a first pressure, e.g., substantially ambient, through a regenerator filled with a suitable packing material (heat release cycle). The heat content of these gases is thereby transferred to the packing of the regenerator. At the same time, dust particles and corrosive components (e.g., sulfur compounds) present in the gas are deposited on the packing of the regenerator column. After a period of time, the flow of the hot waste gases is stopped and the regenerator is eventually switched over to a heat recovery cycle. In the heat recovery cycle, entering gases free of corrosive components and dust particles, preferably compressed to higher pressure than said first pressure, are passed through the regenerator countercurrently to the direction of the flow of the waste gases. Thus, the heat stored in the packing of the regenerator is absorbed by the heat recovery gas. During this cycle, compressed air, for example, can be used at the purge gas. It will be obvious to those skilled in the art that other heat recovery gases can also be used in accordance with this invention, e.g., nitrogen or carbon dioxide.

Bearing the mind the function of pressure during the heat recovery step, the heat recovery gas is preferably compressed to a pressure of 4 to 40 atmospheres, especially 10 to 30 atmospheres.

A special preferred feature of this invention is that dust particles are removed from the packing by a pressure surge occurring immediately (i.e., 2 to 22, preferably 3 to 12 seconds) before the flow of hot waste gases is switched from one regenerator to another, said pressure surge being preferably obtained from the heat recovery gas. The pressure surge is preferably passed from the hot end of the higher pressure regenerator in the heat recovery cycle into the hot end of a lower pressure regenerator in the heat release cycle and it effectively dislodges dust particles entrained in the packing of the regenerator. The dislodged dust particles are carried by the now-cooled waste gases into a filter, downstream of the regenerators, which entrains the dust particles. Subsequently, the cooled waste gases are discharged into a flue.

(In this specification and the appended claims, the hot or warm end of the regenerator designates the end of the regenerator into which hot waste gases are introduced during the operating cycle. Conversely, the cold end designates the end of the regenerator from which the waste gases exit after passing through the regenerator in the operating cycle.)

To effectively dislodge dust particles from the packing, the pressure surge should have a minimum pressure of 4 atmospheres, and preferably 20 to 40 atmospheres, and it should last for at least 1 to 20, preferably for 5 to 10 seconds.

Any sulfuric acid, which condenses on the packing in the regenerators is collected, together with any condensed water, at the cold end of the regenerator and removed therefrom. Such removal can be conducted by steam which would help strip the packing of acid as well as dilute same. This would ordinarily require another regenerator and a special cycle. Alternatively, steam is introduced alternately into one to the regenerators in the region of their cold ends during the switching process.

This invention is especially applicable to waste gases such as flue gas consisting of 75.2% $N_2$ and Ar, 1.6% $O_2$13.6% $CO_2$, 0.2% $SO_2$ and 9.4% $H_2O$ or waste gas from a rotary kiln containing 5 grams $SO_3$, 4 grams $SO_2$ and 0.15 grams $TiO_2$ (dust) per $Nm^3$.

When the regenerators are used in accordance with this invention, the heat content of waste gases which would otherwise be difficultly removable because of the high dust/corrosives content, is transferred to the heat recovery gas relatively free of dust and corrosive substances, which gas can then be conducted to a waste heat boiler or to a turbine to recover the heat content thereof in a relatively trouble-free manner. Another advantage attained by the features of the present invention is that, due to the relative absence of corrosive components, the heat recovery gas can be cooled to substantially lower temperatures, than the gases containing corrosive components, without condensation of corrosive substances, thereby resulting in the recovery of a larger proportion of the heat content therein.

It is advantageous to fill the regenerator with rocks preferably having an average particle size of about 1.1 to 1.5 cm, as the packing material. In a preferred embodiment of the present invention quartzite rocks are used as the packing because they are especially resistant to the corrosion of acidic desposits.

Raschig rings, preferably porcelain Raschig rings, or Raschig rings of sintered corundum, can also be used as the packing material. Raschig rings exhibit a particularly large surface/volume ratio. In addition, their porosity is about 70%; hence, the regenerators filled with Raschig rings can be designed to have a relatively small diameter and a small pressure drop. Such design results in construction cost savings and in savings in the operating cost of the regenerators. Of course, any other commercially available, temperature and acid resistant packing can be used.

BRIEF DESCRIPTION OF THE DRAWING

The attached drawing is a schematic illustration of the preferred embodiment of this invention.

The illustrated embodiment, shown in the sole FIGURE, relates to an installation for recovering the waste heat of the gases of an electricity generating plant, wherein regenerators are employed in accordance with this invention.

The drawing schematically shows how the waste heat of an electric plant 1 is transferred to air (purge gas) in a pair of reversible regenerators 2 and 2A according to the invention. The regenerators 2 and 2A shown in the drawing are used instead of a conventional combustion chamber of an open gas turbine cycle.

The regenerator vessel and the adjoining fittings and pipelines are made of acid-resistant material in the gas contact zone. Suitable materials of construction are, for example, stainless steel, or any other conventional acid-resistant materials.

In the illustrated process, 123,000 $Nm^3$/hour of waste gases at 1000° C., is withdrawn from the electric plant 1 via conduit 9 and it is mixed with 12,500 $Nm^3$/hour of air at 20° C. The resulting air-waste gas mixture has a temperature of 900° C. This mixture is introduced through an open valve 13 in a conduit 10A into a regenerator 2 and it releases its heat to the quartzite rock packing. Simultaneously, dust and corrosive components are deposited on the regenerator packing. Valves 15 and 16 are closed to prevent the introduction of the hot waste gases into the regenerator 2A which undergoes reverse purge cycle of heat recovery with air, described in detail hereinafter. Valve 14 is also closed to prevent the introduction of the waste gases into a conduit 20 leading to a turbine or a waste heat boiler 4.

The sulfuric acid precipitated in the regenerator 2 is collected, together with any condensed water that may have been formed, at the cold end of the regenerator. In addition, if it is desired to dilute the sulfuric acid on the regenerator packing and to force it to run off more quickly, the regenerator 2 can be exposed to steam during a special operating cycle. However, for this purpose a third regenerator, not shown in the drawing, would have to be provided. The thus-discharged acid can be neutralized, for example with lime.

The residence time of the air-waste gas mixture in the regenerator 2 generally ranges from 8 to 20 min.

After the air-waste gas mixture has substantially transferred its heat content to the regenerator 2, the gas mixture is compressed from about 0.75 atmosphere absolute to 1 atmosphere absolute by a suction draft blower 5 and it is conducted via a dust filter 6 into a flue 8.

During the operating cycle described above for the regenerator 2, the regenerator 2A is undergoing the reverse cycle of heat recovery. In the heat recovery cycle, pressurized air is passed through the regenerator previously heated with the waste gases, as described above for the regenerator 2. The air is introduced into the cold end and it exits at the warm end of the regenerator 2A. In the heat recovery cycle, ambient air at 1 atmosphere absolute and 20° C. is compressed to 14 atmospheres absolute in a compressor 3 and is heated during this step to 180° C. Then, the compressed air is fed through a connecting conduit **11*b* and the open valve 24 into the regenerator 2A. The air is heated in the regenerator 2A to 880° C. The hot air, which is still at a pressure of 14 atmospheres absolute, is subsequently subjected to engine expansion in a turbine 4. At the output side of the turbine, air at 1 atmosphere absolute and 383° C. is discharged and introduced into the flue 8**. The thermodynamic degree of efficiency of this process is approximately 40%.

During this cycle, valves 15, 16 and 23 are closed, while the valves 24 and 17 are opened. The heat recovery cycle lasts for 5 to 30, preferably for 8 to 15 minutes.

Dust deposits in the regenerator 2 are removed therefrom by passing a switching surge, occurring during the switchover step of the regenerators 2 and 2A, via the hot end of the regenerator 2. The switching surge is produced in the regenerator 2 during the reversing process the operating cycles of the regenerator 2 and 2A, i.e., while the regenerator 2 is converted to the heat recovery cycle and the regenerator 2A to the heat release cycle. However, the surge is produced while the regenerator 2 is still in the heat release cycle and the regenerator 2A in the heat recovery cycle. To produce the surge, the valve 15, connecting the regenerators 2 and 2A is opened for 1 to 20 seconds. This time is sufficient to provide sudden influx of high pressure air into the regenerator 2, operated in the heat release cycle at about ambient pressure (1 atmosphere). To obtain the desired pressure surge, there is usually employed generally only about 30 to 60, preferably only about 40 to 50% of the high pressure gas in regenerator 2A. The sudden influx of the high pressure air effectively dislodges dust particles entrained in the packing of the regenerator 2. The dislodged dust particles are entrained in the downstream filter 6.

After the switching surge is completed, the regenerator 2 is switched to the purge cycle by closing valves 13, 15, and 21, and opening valves 14 and 22. The regenerator 2A is simultaneously switched to the operating cycle in a manner described above for the regenerator 2, viz, by closing valves 15, 24 and 17 and opening valves 16 and 23.

If it is desired to maintain the temperature in the regenerator 2 below the acid dew point, the exit temperature from the compressor 3 can be adjusted to be correspondingly high so that the cold end of the regenerator is maintained at a temperature higher than the acid dew point of the waste gas.

After having connected regenerators 2 and 2A they both are substantially at the same pressure. In order to reduce the pressure in the regenerator which is to be filled with waste gas in the next switching cycle valves 18 or 19 are opened respectively and the air is dislodged through conduits 12*a* and 12*b*, respectively. A muffler 7 reduces sound emmission.

The preceding example can be repeated with similar success by substituting the generically or specifically described reactants and/or operating conditions of this invention for those used in the preceding example.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. A process for recovering the heat content of hot waste gas containing dust particles comprising the steps of (a) in a heat release step, passing the hot waste gas into one of at least two interchangeable and cyclically connected regenerators to release the heat content of the gas therein, each of said regenerators containing packing for storing said heat content and during said heat release step depositing a portion of said dust particles onto said packing and prior to the end of step (a) passing a pressure surge into said regenerator so as to dislodge said dust particles from the packing; (b) withdrawing from said regenerator resultant cooled waste gas containing substantially all of said dust particles; (c) in a heat recovery step, passing a heat recovery gas into said regenerator to recover the heat stored in the packing thereof, said heat recovery gas absorbing substantially no dust particles deposited in step (a); and (d) withdrawing resultant heated substantially dust-free heat recovery gas from step (c) from the regenerator.

2. A process according to claim 1 wherein said regenerator in step (a) contains sulfuric acid which is not effectively withdrawn in step (b), and wherein said heat recovery gas passed into the regenerator in step (c) is at a sufficient pressure to prevent substantial vaporization of said sulfuric acid during step (c).

3. A process according to claim 1 wherein air is used as said heat recovery gas.

4. A process according to claim 1, said pressure surge comprising prior to switching the operation of said at least one regenerator from the heat release step (a) to the heat recovery step (c), introducing at least a portion of the heat recovery gas from the warm end of a second regenerator in the heat recovery cycle, into the warm end of said at least one regenerator in the heat release cycle.

5. A process according to claim 1, wherein said heat recovery gas is compressed air which after step (c) is passed to a turbine coupled to a compressor for compressing said air prior to entry in step (c).

6. A process according to claim 1, wherein the pressure surge occurs about 2 to 22 seconds prior to the end of step (a).

7. A process according to claim 1, wherein the pressure surge occurs about 3 to 12 seconds prior to the end of step (a).

8. A process according to claim 6, wherein step (a) lasts for 8 to 20 minutes.

9. A process according to claim 8, wherein the pressure surge is hot air under a pressure of 4 to 40 atmospheres, and it lasts for at least about 1 second.

10. A process according to claim 8, wherein the pressure surge is hot air under a pressure of 20 to 40 atmospheres, and it lasts for at least about 1 second.

11. A process according to claim 9, wherein said hot air is the heat recovery gas of step (d).

12. A process according to claim 11, wherein the said hot air pressure surge constitutes about 30–60% of the heat recovery gas of step (d).

13. A process according to claim 1, wherein the pressure surge is obtained from the heat recovery gas of step (d).

14. A process according to claim 1, wherein the pressure surge comprises an added gas having a pressure at least about 3 atmospheres higher than the hot waste gas, and said surge lasts for 1 to 20 seconds.

15. A process according to claim 14, wherein the pressure surge comprises an added gas having a pressure about 19–39 atmospheres higher than the hot waste gas, and the surge lasts for 5–10 seconds.

16. A process according to claim 14, wherein the pressure surge occurs about 2 to 22 seconds prior to the end of step (a).

17. A process according to claim 14, wherein step (a) lasts for 8 to 20 minutes.

18. A process according to claim 16, wherein step (a) lasts for 8 to 20 minutes.

19. A process for recovering the heat content of hot waste gas containing sulfuric acid comprising the steps of (a) in a heat release step, passing the hot waste gas into one of at least two interchangeable and cyclically connected regenerators to release the heat content of the gas therein, each of said regenerators containing packing for storing said heat content and during said heat release step depositing at least a portion of said sulfuric acid onto said packing; (b) withdrawing resultant cooled waste gas from said regenerator but leaving behind at least a portion of said sulfuric acid on said packing; (c) in a heat recovery step, passing a heat recovery gas into said regenerator to recover the heat stored in the packing thereof, said heat recovery gas on entry into said regenerator being at sufficient pressure to prevent substantial vaporization of said sulfuric acid during step (c); and (d) withdrawing resultant heated heat recovery gas from step (c) from the regenerator.

20. A process according to claim 19 wherein air is used as said heat recovery gas.

21. A process according to claim 20 wherein the air is introduced at about 14 atmospheres absolute.

* * * * *